US006500996B1

(12) United States Patent
Brown et al.

(10) Patent No.: US 6,500,996 B1
(45) Date of Patent: Dec. 31, 2002

(54) PROCESS FOR BTX PURIFICATION

(75) Inventors: Stephen H. Brown, Princeton; Tarun K. Chaudhuri, Princeton Junction, both of NJ (US); Jose G. Santiesteban, West Chester, PA (US)

(73) Assignee: ExxonMobil Oil Corporation, Fairfax, VA (US)

( * ) Notice: Subject to any disclaimer, the term of this patent is extended or adjusted under 35 U.S.C. 154(b) by 0 days.

(21) Appl. No.: 09/428,762

(22) Filed: Oct. 28, 1999

(51) Int. Cl.[7] ..... C07C 2/66; C07C 7/00

(52) U.S. Cl. ..... 585/323; 585/319; 585/446; 585/467; 585/804; 585/805; 208/257; 208/260

(58) Field of Search ..... 585/802, 804, 585/805, 446, 467, 319, 323; 208/257, 260

(56) References Cited

U.S. PATENT DOCUMENTS

| | | | | |
|---|---|---|---|---|
| 2,778,863 | A | 1/1957 | Maisel et al. | |
| 3,400,169 | A | 9/1968 | Eng et al. | |
| 3,761,389 | A | 9/1973 | Rollmann | |
| 3,835,037 | A | 9/1974 | Fairweather et al. | |
| 3,888,939 | A | 6/1975 | Rosback | |
| 4,053,367 | A | 10/1977 | Gewartowski | |
| 4,211,886 | A | 7/1980 | Tabek et al. | |
| 4,309,281 | A | 1/1982 | Dessau | |
| 4,401,554 | A | 8/1983 | Choi et al. | |
| 4,501,652 | A | 2/1985 | Le et al. | |
| 4,795,550 | A | 1/1989 | Sachtler et al. | |
| 4,954,325 | A | 9/1990 | Rubin et al. | |
| 5,019,670 | A | 5/1991 | Le et al. | 585/467 |
| 5,105,039 | A | 4/1992 | Pelrine | 585/407 |
| 5,132,477 | A | 7/1992 | Ho et al. | 585/467 |
| 5,229,341 | A | 7/1993 | Kresge et al. | |
| 5,236,575 | A | 8/1993 | Bennett et al. | |
| 5,296,428 | A | 3/1994 | Degnan et al. | |
| 5,330,946 | A | 7/1994 | Hynes et al. | |
| 5,347,061 | A | 9/1994 | Harandi et al. | 585/208 |
| 5,362,697 | A | 11/1994 | Fung et al. | |
| 5,414,172 | A | 5/1995 | Chin et al. | 585/208 |
| 5,536,894 | A | 7/1996 | Degnen et al. | 585/467 |
| 5,545,788 | A | 8/1996 | Cheng et al. | |
| 5,683,573 | A | 11/1997 | Haizmann et al. | |
| 5,689,027 | A | 11/1997 | Abichandani et al. | |
| 5,792,338 | A | 8/1998 | Gosling et al. | |
| 5,865,986 | A | 2/1999 | Buchanan et al. | |
| 5,865,988 | A | 2/1999 | Collins et al. | 208/97 |
| 6,031,144 | A * | 2/2000 | Campbell | 585/449 |
| 6,368,496 | B1 * | 4/2002 | Brown et al. | |

FOREIGN PATENT DOCUMENTS

| | | | |
|---|---|---|---|
| EP | 0032414 A | 7/1981 | |
| EP | 0382960 A | 8/1990 | |
| EP | 0780458 A | 6/1997 | |
| WO | WO93/03116 | 2/1993 | |
| WO | 99/38936 | 8/1999 | C10G/29/04 |

OTHER PUBLICATIONS

Alemany et al. Detailed Analysis of $C_5$ and $C_6$ Dienes in Light Process Streams. *Energy and Fuels* 9:257–268 (1995).

N. Dachos et al., *Handbook of Petroleum Refining Processes*, 2nd Edition, R. A. Meyers, Ed., McGraw–Hill, New York, 1997, pp. 4.3–4.26.

* cited by examiner

*Primary Examiner*—Walter D. Griffin

(57) ABSTRACT

A process for the removal of hydrocarbon contaminants, such as dienes and olefins, from an aromatics reformate by contacting an aromatics reformate stream with a hydrotreating catalyst and/or a molecular sieve. The hydrotreating catalyst substantially converts all dienes to oligomers and partially converts olefins to alkylaromatics. The molecular sieve converts the olefins to alkylaromatics. The process provides an olefin depleted product which can be passed through a clay treater to substantially convert the remaining olefins to alkylaromatics. The hydrotreating catalyst has a metal component of nickel, cobalt, chromium, vanadium, molybdenum, tungsten, nickel-molybdenum, cobalt-nickel-molybdenum, nickel-tungsten, cobalt-molybdenum or nickel-tungsten-titanium, with a nickel molybdenum/alumina catalyst being preferred. The molecular sieve is an intermediate pore size zeolite, preferably MCM-22. The clay treatment can be carried out with any clay suitable for treating hydrocarbons.

9 Claims, 7 Drawing Sheets

PROCESS FOR BTX PURIFICATION

BACKGROUND OF INVENTION

The present invention relates to removing olefins and dienes from aromatic streams. In particular, the present invention relates to a method for selectively converting undesirable components such as dienes and olefins to provide a substantially purified aromatic product.

Aromatic streams are derived from processes such as naphtha reforming and thermal cracking (pyrolysis) and can be used as feedstocks in a variety of petrochemical processes, such as para-xylene production from an aromatic stream containing benzene, toluene and xylene (BTX), or toluene disproportionation. However, aromatic streams often contain hydrocarbon contaminants including mono-olefins, dienes, styrenes and heavy aromatic compounds, such as anthracenes, which can cause undesirable side reactions in these processes. Therefore, these hydrocarbon contaminants must be removed from reformate-derived aromatic streams before they can be used in other processes.

Improved processes for aromatics production, such as that described in the Handbook of Petroleum Processing, McGraw-Hill, New York 1997, pp. 4.3–4.26, provide increased aromatics yield but also increase the amount of contaminants. For example, the shift from high-pressure semi-regenerative reformers to low-pressure moving bed reformers results in a substantial increase in bromine reactive contaminants in the reformate derived streams. This in turn results in a greater need for more efficient and less expensive methods for removal of hydrocarbon contaminants from aromatic streams.

Undesirable hydrocarbon contaminants containing olefinic bonds are quantified by the Bromine Index (BI). The number of grams of bromine absorbed by 100 grams of a hydrocarbon or a hydrocarbon mixture indicates the percentage of double bonds present. Thus, when the type and molecular weight is known, the contents of the olefin can be calculated. The Bromine Indices (i.e., numbers) of the hydrocarbon feeds and products are measured to determine the change in composition. Molecular sieves and clay treating have been used to reduce the Bromine Indices of various hydrocarbon products.

The clay treatment of hydrocarbons is widely practiced in the petroleum and petrochemical industries. Clay treating is used to remove impurities from hydrocarbons in a wide variety of processes. Most often, the heavier hydrocarbons, that is those having six or more carbon atoms per molecule, are subjected to clay treating rather than lighter hydrocarbons. One of the most common reasons for clay treating these materials is to remove olefinic materials, sometimes called "bromine contaminants," in order to meet various quality specifications. As used herein the term "olefinic compound" or "olefinic material" is intended to refer to both mono and diolefins. Olefinic materials may be objectionable in aromatic hydrocarbons at even very low concentrations of less than a few parts per million. For example, in the manufacture of nitration grade aromatics including benzene, toluene and xylenes, it is essential to remove these olefinic materials from the feedstock.

Undesirable olefins, including both dienes and mono-olefins, have typically been concurrently removed from aromatic streams, such as benzene, toluene and xylene ("BTX") streams, by contacting the aromatic stream with acid-treated clay. Other materials, such as zeolites, have also been used for this purpose. Clay is an amorphous naturally-occurring material and, consequently, relatively inexpensive. However, zeolites used for this purpose are usually synthesized and are, therefore, more expensive. Both clay and zeolites have very limited lifetimes in aromatics treatment services. The length of service correlates with the level of bromine reactive impurities in the feedstream, since BI-reactive contaminants rapidly age both clay and zeolites. Indeed, although clay is the less expensive of the two alternatives, it is still a significant expense and it is not uncommon for large aromatic plants to spend close to a million dollars a year on clay. Furthermore, since zeolites are considerably more expensive than clay, their use in removing hydrocarbon contaminants from aromatic streams is impractical unless their cycle length can be increased.

The high cost of catalysts and the loss of production when the process is shutdown to replace the spent catalyst has created a need for an efficient and cost effective method for removing contaminants from reformate-derived aromatic streams. The present invention solves this problem by advantageously using a combination of catalytic reactors and clay treaters to more efficiently remove contaminants from reformate-derived aromatic streams while extending the life of the catalysts.

SUMMARY OF THE INVENTION

In accordance with the present invention, a method is provided for the treatment of aromatics reformate to remove olefins therefrom by contacting the reformate with a molecular sieve to convert the olefins to alkylaromatics. Preferably, the molecular sieve is a zeolite, most preferably a large pore size zeolite. The reformate can be contacted with a hydrotreating catalyst prior to contacting with the molecular sieve to substantially convert dienes contained therein to oligomers and to partially convert the olefins to alkylaromatics. In addition, the reformate can also be clay treated after contacting with the molecular sieve to substantially convert the remaining olefins to alkylaromatics.

In another embodiment of the present invention, a method is provided for the treatment of aromatics reformate to remove dienes and olefins. The method includes: contacting an aromatics reformate containing dienes and olefins with a hydrotreating catalyst to substantially convert the dienes to oligomers and to partially convert the olefins to alkylaromatics; contacting the reformate with a molecular sieve to further convert the olefins to alkylaromatics to provide an olefin depleted product, wherein less than 30 percent of the olefins in the aromatics reformate remain in the depleted product; and clay treating the olefin depleted product to substantially convert the remaining olefins to alkylaromatics. In a preferred embodiment, more than 95 percent of the dienes and the olefins in the aromatics reformate are converted. Using the Bromine Index as a measure of olefin content, the present invention reduces the Bromine Index of an aromatics stream from about 300 to 1,000 to below 100.

The hydrotreating catalyst has a metal component selected from the group consisting of: nickel, cobalt, chromium, vanadium, molybdenum, tungsten, nickel-molybdenum, cobalt-nickel-molybdenum, nickel-tungsten, cobalt-molybdenum and nickel-tungsten-titanium. The support for the catalyst is conventionally a porous solid, usually alumina, or silica-alumina but other porous solids such as magnesia, titania or silica, either alone or mixed with alumina or silica-alumina may also be used, as convenient. A preferred hydrotreating catalyst is a nickel molybdenum/alumina.

The olefin removal is preferably carried out using a large pore size zeolite as a molecular sieve, wherein the zeolite is ZSM-4, ZSM-12, mordenite, ZSM-18, ZSM-20, zeolite beta, Faujasite X, Faujasite Y, USY, REY and other forms of X and Y, MCM-22, MCM-36, MCM-49, MCM-56, M41S or MCM-41. The preferred zeolites are MCM-22 and zeolite beta, most preferably a self-bound MCM-22 zeolite.

After the aromatics reformate has been hydrotreated and contacted with a molecular sieve to remove the dienes and at least 70% of the olefins, it is clay treated to substantially remove the remaining olefins. The clay treating is carried out at a temperature of from about 100 to about 240° C. and at a pressure of from about 100 to about 300 psig. Any clay suitable for processing hydrocarbons can be used, preferably Engelhard F-24 clay, Filtrol 24, Filtrol 25, and Filtrol 62, Attapulgus clay or Tonsil clay, with Engelhard F-24 clay being the most preferred. In one embodiment of the present invention, the aromatics reformate is clay treated after the hydrotreater and before the molecular sieve reactor.

In a preferred embodiment, the method of the present invention also includes separating the oligomers from the reformate after contacting with the hydrotreating catalyst and prior to contacting with the molecular sieve. This allows the alkylation of olefins in the molecular sieve reactor to be carried out more efficiently. However, it is within the scope of the present invention for the oligomers to be separated downstream of the molecular sieve reactor and the clay treater.

It has been found that the best mode for practicing the present invention employs a nickel molybdenum/alumina hydrotreating catalyst, a self-bound MCM-22 zeolite and Engelhard F-24 clay. This combination of catalysts and clay efficiently removes the contaminants from the aromatics reformate and extends the life of the catalysts.

By using both a zeolite bed and a clay treater, the present invention takes advantage of the high conversion rate of zeolites and the low cost of clay to reduce catalyst consumption, extend catalyst life and reduce the system operating costs.

BRIEF DESCRIPTION OF THE FIGURES

Other advantages and attendant features of this invention will be readily appreciated as the invention becomes better understood by reference to the following detailed description when considered in connection with the accompanying drawings wherein.

DETAILED DESCRIPTION OF THE INVENTION

Figure 1:
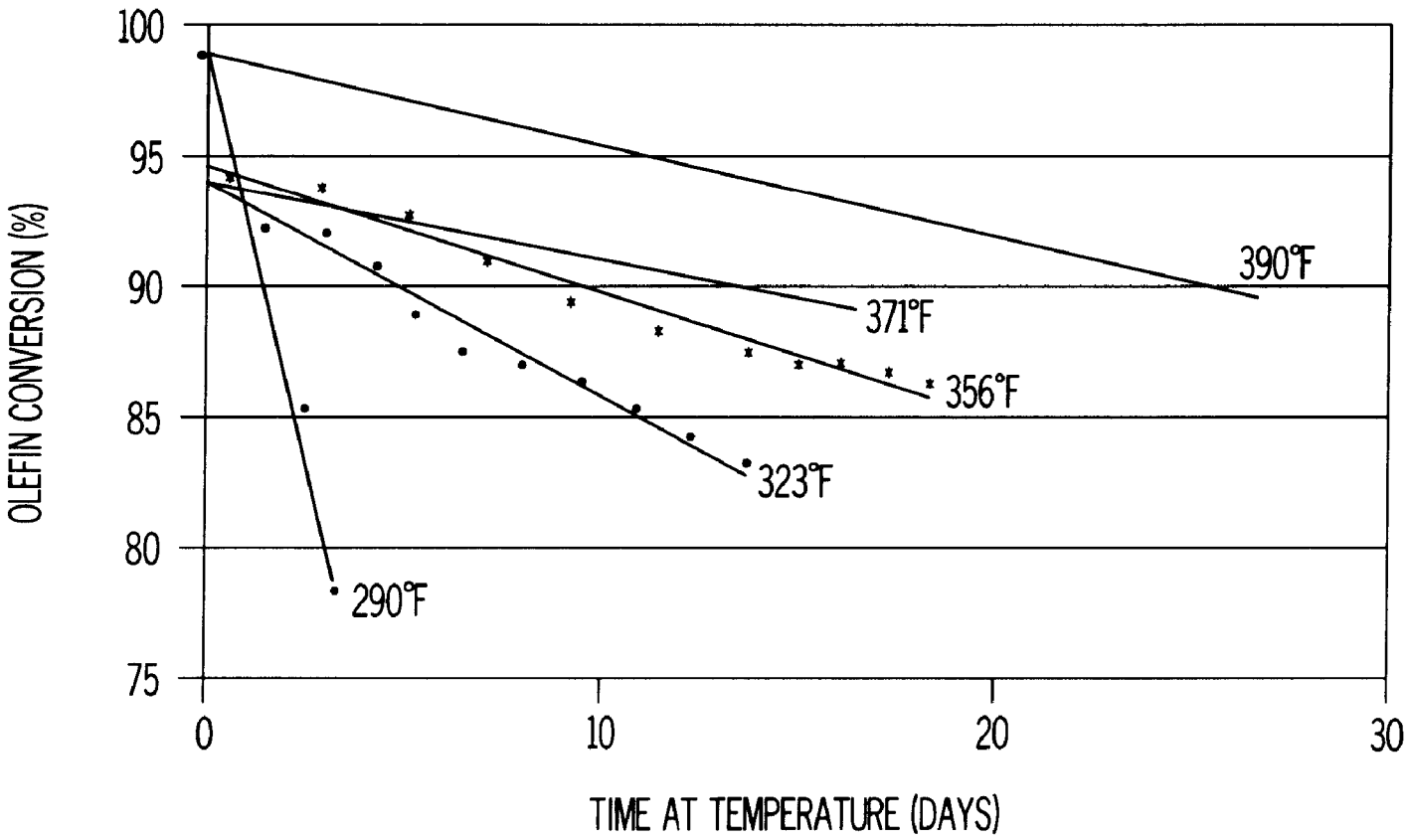
FIG. 1 is a graph showing olefin conversion at different temperatures over time.

Commercial hydrotreating catalysts have proved active and stable for the conversion of low levels of olefins and dienes in reformate to oligomers. The method of the present invention improves the profitability of these processes by using catalyst beds and a clay treater to reduce the amounts of catalysts that are used and to extend the life of the catalysts.

In the method of the present invention, a hydrotreating catalyst first contacts the reformate and substantially converts all dienes to oligomers, while partially converting olefins. Adjusting the weight hourly space velocity (WHSV) of the hydrotreating catalyst bed controls the amount of olefin converted and, hence, the composition of the resulting heavy product. In a one embodiment of the present invention, the product stream from the hydrotreating catalyst reactor contacts a zeolite, which converts most of the remaining olefins to alkylaromatics, so that less than 30% of the olefins initially present in the reformate remain. These alkylaromatics co-boil with a portion of the products from the hydrotreating catalyst. In a preferred embodiment of the present invention, all or a portion of the effluent from the hydrotreating catalyst bed is distilled to isolate the oligomeric products of diene conversion. In addition to allowing the isolation and sale of the products from the first bed, the removal of the oligomeric products of diene conversion also changes the composition of the heavy stream obtained downstream of the zeolite bed. When the condensed products are collected for sale via distillations, the properties of these condensed products can vary based on the process operating parameters, including the unit temperature, pressure, and WHSV.

Clay treaters used for the treatment of aromatics reformate streams are generally operated as swing-bed units. When the clay is spent, the aromatics stream is directed to a second reactor containing fresh clay, while the first reactor is emptied and reloaded. Clay costs about $0.50/lb, while the catalysts can cost as much as $60/lb. For this reason, a process which makes the most efficient use of catalysts for swing-bed operation is highly desirable. For example, it can be advantageous to switch to a clay bed reactor while catalysts are replaced or regenerated and reloaded, instead of using a spare reactor with a catalyst fill.

One of the advantages of using a catalyst system is stable, or nearly stable, operation. The major disadvantage of a catalyst system is the high price of the catalyst materials. It is, therefore, more economical to operate the catalyst system at the highest possible WHSV in order to increase the productivity of the catalysts, even though catalyst cycle lengths usually decrease as WHSV increases. In an aromatics purification process, essentially all of the olefins and dienes in the stream have to be removed and so conversion rates must be close to 100 percent. However, the amount of catalyst required to remove 90% of the olefins and dienes from the aromatics is only one-fourth as much as the amount required to purify the aromatics (i.e., remove about 99% of the olefins and dienes). Thus, 75% of the catalyst cost is incurred in removing the final 10% of the olefins and dienes.

One embodiment of the present invention reduces the catalyst cost by using a 3-bed system. In a first bed, a hydrotreating catalyst is used to remove the dienes from the aromatics. The dienes depleted stream is then sent to a second bed where a zeolite is used to remove more than 70% of the olefins. The effluent from the zeolite bed is sent to a third bed where cheap clay is used to finish the olefin removal job. The hydrotreating catalyst bed, the zeolite bed and the clay bed can be combined in a single reactor vessel or they can be in separate reactors. The choice primarily depends on the composition of the aromatics stream and the aging characteristics of the catalysts.

The method of the present invention provides two significant advantages. First, the life of the clay is extended because the catalysts remove over 70% of the olefins before the aromatics stream contacts the clay. Thus, the clay is required to remove less than 30% of the olefins. This allows the clay reactors to operate for extended periods before the clay in the reactor has to be replaced. Second, the use of the clay reactor reduces the amount of expensive catalysts needed to remove the olefins. Approximately half of the amount of catalyst used in prior art aromatics purification processes is required by the method of the present invention to remove 70% of the olefins, while the balance of the olefins are removed using inexpensive clay.

The hydrotreating catalyst used for removing dienes and the zeolite used for olefin removal generally have different aging rates. If one of the catalysts is more stable, it can be advantageous to have the hydrotreating catalyst and the zeolite in separate reactors. This allows the catalyst that ages more rapidly, and, therefore, has to be replaced more frequently, to be operated in a swing-bed fashion, while the stable catalyst can be operated in a single vessel. The zeolite is more expensive and this provides an incentive to operate at higher weight hourly space velocities (WHSV) than the hydrotreating catalyst in order to increase the catalyst cycle length. Therefore, placing the zeolite in a separate reactor allows change-out and regeneration of spent zeolite, without the cost of stripping, cooling, unloading and reloading the larger amount of hydrotreating catalyst.

Process Conditions

In accordance with the present invention, the above described feedstock may be contacted with the catalyst system under suitable conversion conditions to convert dienes to oligomers and olefins to alkylaromatics. Examples of these conversion conditions include a temperature of from about 100° F. to about 700° F., a pressure of from about 15 to about 1,000 psig, a weight hourly space velocity (WHSV) of between about 0.1 and about 200 $hr^{-1}$. Alternatively, the conversion conditions may include a temperature of from about 350° F. to about 480° F., a pressure of from about 50 to about 400 psig, a WHSV of between about 3 and about 50 $hr^{-1}$. The WHSV is based on the weight of catalyst composition, i.e., the total weight of active catalyst plus any binder that is used.

When the hydrotreating catalyst and zeolite are in separate reactors, each reactor can have different operating conditions. In a preferred embodiment, the olefin conversion reactor is maintained at temperatures ranging from about 300° F. to about 500° F. Operating pressures are, usually, greater than atmospheric, above about 20 psig (239 kPa), specifically above about 50 psig (446 kPa) up to about 1000 psig (6996 kPa). The catalyst space velocity is, typically, from about 5 to about 30 WHSV.

The clay treating zone may be of any type and configuration which is effective in achieving the desired degree of purification. It may utilize either upward or downward flow, with downward flow being preferred. The pressure in the clay treating zone should be sufficient to maintain liquid phase conditions. This will normally be a pressure of from about 50 to about 500 psig. Preferably the pressure is set about 50 psig higher than the vapor pressure of the hydrocarbons at the inlet temperature of the zone. This temperature is preferably within the range of from about 270° F. to about 475° F. Clay treating may be performed over a broad range of liquid hourly space velocities. This variable is often set by the desired on-stream life of the clay and may range from 0.5 or lower to about 10. Preferred are liquid hourly space velocities of from 1.0 to 4.0 depending on the material being treated.

Hydrotreating Catalyst System

The aromatics reformate-derived stream is initially contacted with a hydrotreating catalyst to substantially convert all dienes to oligomers. The hydrotreating catalyst has a metal component which can be a single metal from Groups VIA and VIIIA of the Periodic Table, such as nickel, cobalt, chromium, vanadium, molybdenum, tungsten, or a combination of metals such as nickel-molybdenum, cobalt-nickel-molybdenum, cobalt-molybdenum, nickel-tungsten or nickel-tungsten-titanium. Generally, the metal component is selected for good hydrogen transfer activity and the catalyst as a whole should have good hydrogen transfer and minimal cracking characteristics. A preferred hydrotreating catalyst is a commercial $NiMo/Al_2O_3$ catalyst, such as HDN-60, manufactured by American Cyanamid. The catalyst is used as it is received from the manufacturer, i.e., in its oxide form. The support for the catalyst is conventionally a porous solid, usually alumina, or silica-alumina but other porous solids such as magnesia, titania or silica, either alone or mixed with alumina or silica-alumina may also be used, as convenient. A preferred hydrotreating catalyst is a nickel molybdenum/alumina.

Upon contact with the hydrotreating catalyst, the diene contaminants in the aromatics reformate-derived stream are substantially converted to oligomers. At the same time and to a lesser extent, olefins are converted to alkylaromatics. The effluent from the hydrotreating stage can be passed directly to the second, or olefin removal, stage without separating the oligomers or the effluent can be sent to a separator to remove the oligomers formed in the first stage.

Zeolite Catalyst System

It is contemplated that any molecular sieve having a pore size appropriate to catalytically alkylate the aromatics can be employed in this reformate purification process. The molecular sieve useful for the olefin conversion step of this invention is usually a large pore size zeolite having a silica-to-alumina molar ratio of at least about 2, specifically from about 2 to 100. The silica to alumina ratio is determined by conventional analysis. This ratio is meant to represent, as closely as possible, the molar ratio in the rigid anionic framework of the zeolite crystal and to exclude silicon and aluminum in the binder or in cationic or other form within the channels.

The catalysts for selectively removing mono-olefin compounds include, e.g., large pore zeolites, particularly MCM-22 type materials, mesoporous materials including those termed M41S, SAPO's, pillared and/or layered materials. It has been found that the most effective type of MCM-22 zeolite catalyst is a self-bound MCM-22 catalyst.

Zeolites are divided into three major groups, according to their pore/channel systems. These systems include 8-membered oxygen ring systems, 10-membered oxygen ring systems, 12-membered oxygen ring systems, and the dual pore systems including 10 and 12-membered oxygen ring openings. In general, they are referred to as small, medium or large pore size zeolites proceeding from 8 to 12 membered systems. These systems are more completely described in Atlas of Zeolite Structure Types, International Zeolite Assoc., Polycrystal Book Service, Plattsburg, 1978.

The chemical composition of zeolites can vary widely and zeolites typically consist of $SiO_2$ structures, in which some of the silicon atoms are replaced by tetravalent ions such as Ti or Ge, trivalent ions such as Al, B, Ga, Fe, bivalent ions such as Be, other members of Group III of the Periodic table of the Elements, or a combination of the aforementioned ions. When there is substitution by bivalent or trivalent ions, cations such as Na+, $Ca^{++}$, $NH_4^+$ or $H^+$ are present in the as-synthesized zeolite structure, along with organic ions such as tetramethylamine ($TMA^+$), tetraethylamine ($TEA^+$) and others. The organics are typically removed by calcination before the zeolite is used. Ion exchange of residual cations with, for example, $NH_4^+$, is generally followed by calcination to produce the acidic zeolite.

Preferred catalysts include natural or synthetic crystalline molecular sieves, with ring structures of ten to twelve members or greater. Crystalline molecular sieves useful as catalysts include as non-limiting examples, large pore zeolites ZSM-4 (omega) (U.S. Pat. No. 3,923,639), mordenite, ZSM-18 (U.S. Pat. No. 3,950,496), ZSM-20 (U.S. Pat. No. 3,972,983), zeolite Beta (U.S. Pat. Nos. 3,308,069 and Re 28,341), Faujasite X (U.S. Pat. No. 2,882,244), Faujasite Y (U.S. Pat. No. 3,130,007), USY (U.S. Pat. Nos. 3,293,192 and 3,449,070), REY and other forms of X and Y, MCM-22 (U.S. Pat. No. 4,954,325), MCM-36 (U.S. Pat. No. 5,229,341), MCM-49 (U.S. Pat. No. 5,236,575), MCM-56 (U.S. Pat. No. 5,362,697) and mesoporous materials such as M41S (U.S. Pat. No. 5,102,643) and MCM-41 (U.S. Pat. No. 5,098,684). More preferred molecular sieves include 12 membered oxygen-ring structures ZSM-12, mordenite, Zeolite Beta, USY, and the mixed 10–12 membered oxygen ring structures from the MCM-22 family, layered materials and mesoporous materials. Most preferred are the MCM-22 family of molecular sieves, which includes, MCM-22, MCM-36, MCM-49 and MCM-56. The MCM-22 type materials may be considered to contain a similar common layered structure unit. The structure unit is described in U.S. Pat. Nos. 5,371,310, 5,453,554, 5,493,065 and 5,557,024. Each of the patents in this paragraph describing molecular sieve materials is herein incorporated by reference.

One measure of the acid activity of a zeolite is the Alpha Value. The Alpha Value is an approximate indication of the catalyst acid activity and it gives the relative rate constant (rate of normal hexane conversion per volume of catalyst per unit time). It is based on the activity of the highly active silica-alumina cracking catalyst taken as an Alpha of 1 (Rate Constant=0.16 $sec^{-1}$). The alpha test is described in U.S. Pat. No. 3,354,078, in the Journal of Catalysis, Vol. 4, p. 527 (1965); Vol. 6, p. 278, and Vol. 61, p. 395 (1980), each of which is herein incorporated by reference as to that description. The experimental conditions of the test used include a constant temperature of 538° C., and a variable flow rate as described in the Journal of Catalysis, Vol. 61, p. 395 (1980). The catalyst have an Alpha Value from about 100 to about 1000.

The crystalline molecular sieve may be used in bound form, that is, composited with a matrix material, including synthetic and naturally occurring substances, such as clay, silica, alumina, zirconia, titania, silica-alumina and other metal oxides. Naturally-occurring clays include those of the montmorillonite and kaolin families. The matrix itself may possess catalytic properties, often of an acidic nature. Other porous matrix materials include silica-magnesia, silica-zirconia, silica-thoria, silica-beryllia, silica-titania, as well as ternary compositions such as silica-alumina-thoria, silica-alumina-zirconia, silica-alumina-magnesia, and silica-alumina-zirconia. A mixture of these components can also be used. The relative proportions of crystalline molecular sieve material and matrix can vary widely from 1 to 90 weight percent, usually about 20 to about 80 weight percent. The catalyst can also be used in the absence of matrix or binder, i.e., in unbound form. The catalyst can be used in the form of an extrudate, lobed form (e.g. trilobe), or powder.

Clay Treating

Clay treating is used herein to refer to the passage of a liquid phase hydrocarbon stream through a fixed bed of contact material which possesses the capability of reacting olefinic compounds present in the hydrocarbon stream. Preferably the contact material is an acidic aluminosilicate. It may be either a naturally occurring material, such as bauxite or mordenite clay, or a synthetic material and may comprise alumina, silica, magnesia or zirconia or some other compound which exhibits similar properties. A preferred clay is Engelhard F-24 clay. However, several other types of clay are available commercially and are suitable for use in the present invention, including Filtrol 24, Filtrol 25 and Filtrol 62 produced by the Filtrol Corporation, Attapulgus clay and Tonsil clay. In a preferred embodiment, the clays are pretreated with concentrated HCl or $H_2SO_4$ acid.

As previously discussed, clay treating is now conducted over a wide temperature range of from about 203° F. to about 475° F. or more. The exact temperature utilized in the clay treating zone is dependent on at least three separate factors. The first of these is the minimum temperature which is required for the contact material to function properly. This temperature is known to increase in a positive relation to the quantity of hydrocarbons which have been treated per unit mass of contact material. The minimum required temperature is therefore affected by the prior use of the clay. A second factor is the particular type of contact material which is being used. This is related to the minimum required temperature, but is an independent factor since individual contact materials exhibit differing degrees of selectivity and other properties, such as useful life, which must be taken into account. For instance, at the same level of color body removal activity two different clays may have varying degrees of catalytic activity for undesired reactions as described below.

Finally, the optimum clay treating temperature will be dependent on intrinsic and extrinsic qualities of the hydrocarbon stream being treated. These qualities include the rate of flow of the hydrocarbon stream and the concentration of olefinic compounds in it.

Depending on the aromatics feedstock and the operating conditions, two or more separate clay treater vessels can be used on an alternating (i.e., swing) basis to provide continuous operation. A clay reactor can also be used as the swing reactor for the zeolite bed when the zeolite is being replaced or regenerated.

EXAMPLE 1

A heavy reformate with a BI of 850 was used as a feedstock. The heavy reformate was a $C_7^+$ cut of full-range cyclic catalytic reformer ("CCR") reformate containing 39 wt % toluene, 40 wt % $C_8$ aromatics, 20 wt % $C_9^+$ aromatics, and 0.45 wt % olefins. No dienes were detected in this feed using standard gas chromatograph ("GC") analysis. This feedstock was processed at 10 WHSV over self-bound MCM-22 at 290, 323, 356, 371 and 390° F. FIG. 1 shows the aging rate as a plot of the activity of the self-bound MCM-22 (i.e., SB MCM-22) versus the time (number of days) on stream.

The aging rate of the catalyst dropped, i.e., each time the MCM-22 reactor temperature was raised. These results show that, when MM-22 is used to treat heavy reformate, its stability is dependent on the reactor temperature. At higher reactor temperatures, the olefin conversion decreases less rapidly and, thus, the catalyst ages more slowly. It is, therefore, advantageous to operate the MCM-22 catalyst at higher temperatures, preferably above 350° F.

EXAMPLE 2

Figure 2:
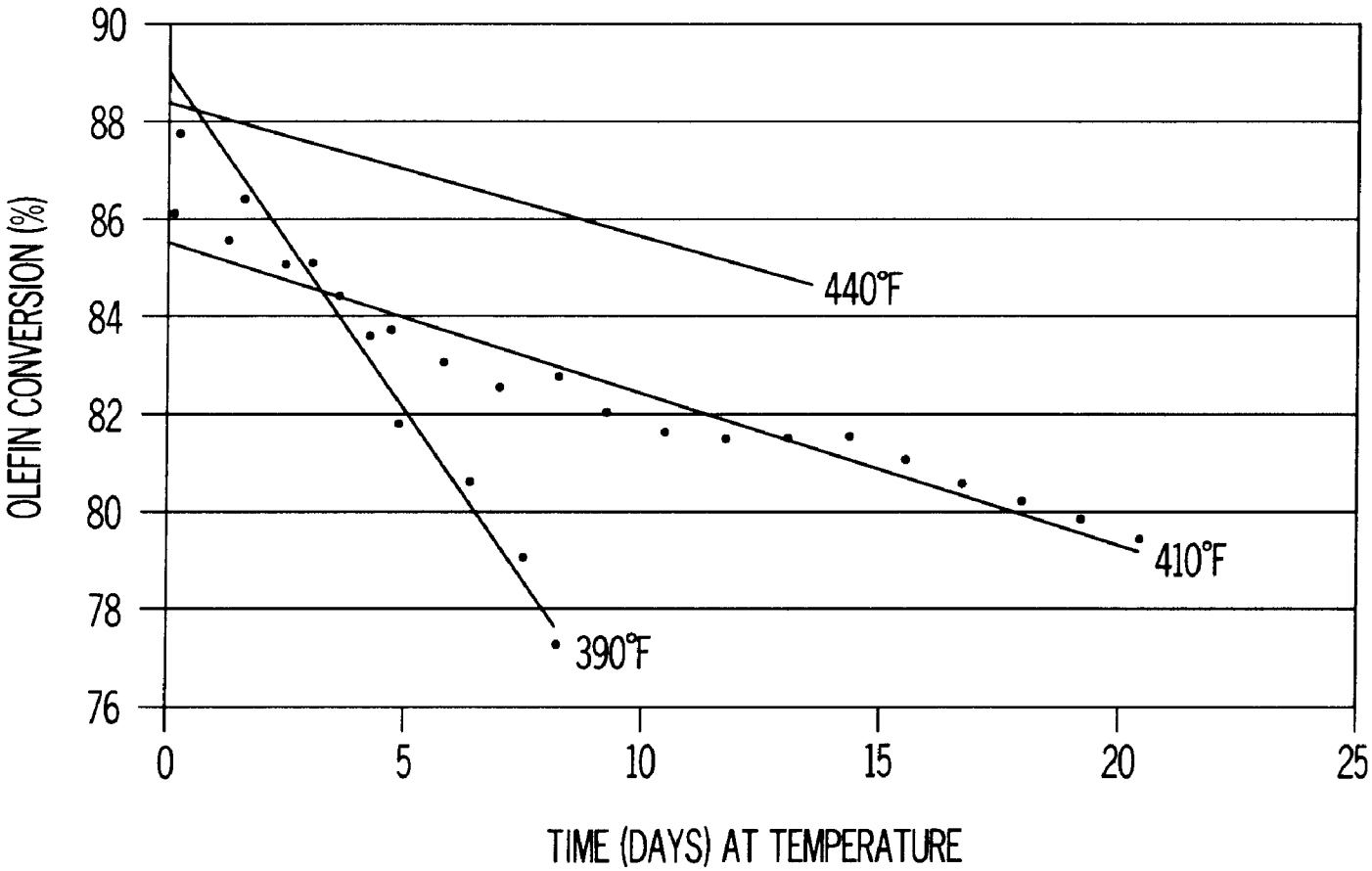
FIG. 2 is a graph showing olefin conversion at different temperatures over time.

A heavy reformate with a BI of 550 was used as a feedstock. The heavy reformate was a $C_7^+$ cut of full-range CCR reformate containing 50 wt % toluene, 37 wt % $C_8$ aromatics, 12 wt % $C_9^+$ aromatics, and 0.27 wt % olefins. No dienes were detected in this feed using standard GC analysis. This feedstock was processed at 52 WHSV over self-bound MCM-22 at 390, 410 and 440° F. FIG. 2 shows the aging rate of the self-bound MCM-22 (i.e., SB MCM-22) as a plot of olefin conversion versus days on stream for each temperature. FIG. 2 shows that as the operating temperature is raised, the olefin conversion increases.

EXAMPLE 3

A light aromatics extract containing 61 wt % benzene and 37 wt % toluene was used as the feedstock for this example. The feedstock contains both olefins and dienes in amounts that can be monitored using a gas chromatograph. The feedstock had a BI of about 80 and contained about 10 ppm of cyclopentadiene, 110 ppm of mixed methylcyclopentadienes, and 125 ppm of olefins. The light aromatics extract was contacted with a HDN-60 hydrotreating catalyst, sized to 60/200 mesh, at 18 WHSV, 150° F., 18 WHSV, 300° F. and 48 WHSV, 450° F. and 350 psig. Gas chromatograph analysis showed that for each run only the diene peaks underwent significant conversion. This demonstrated that HDN-60 has excellent selectivity for diene versus olefin conversion.

Figure 3:
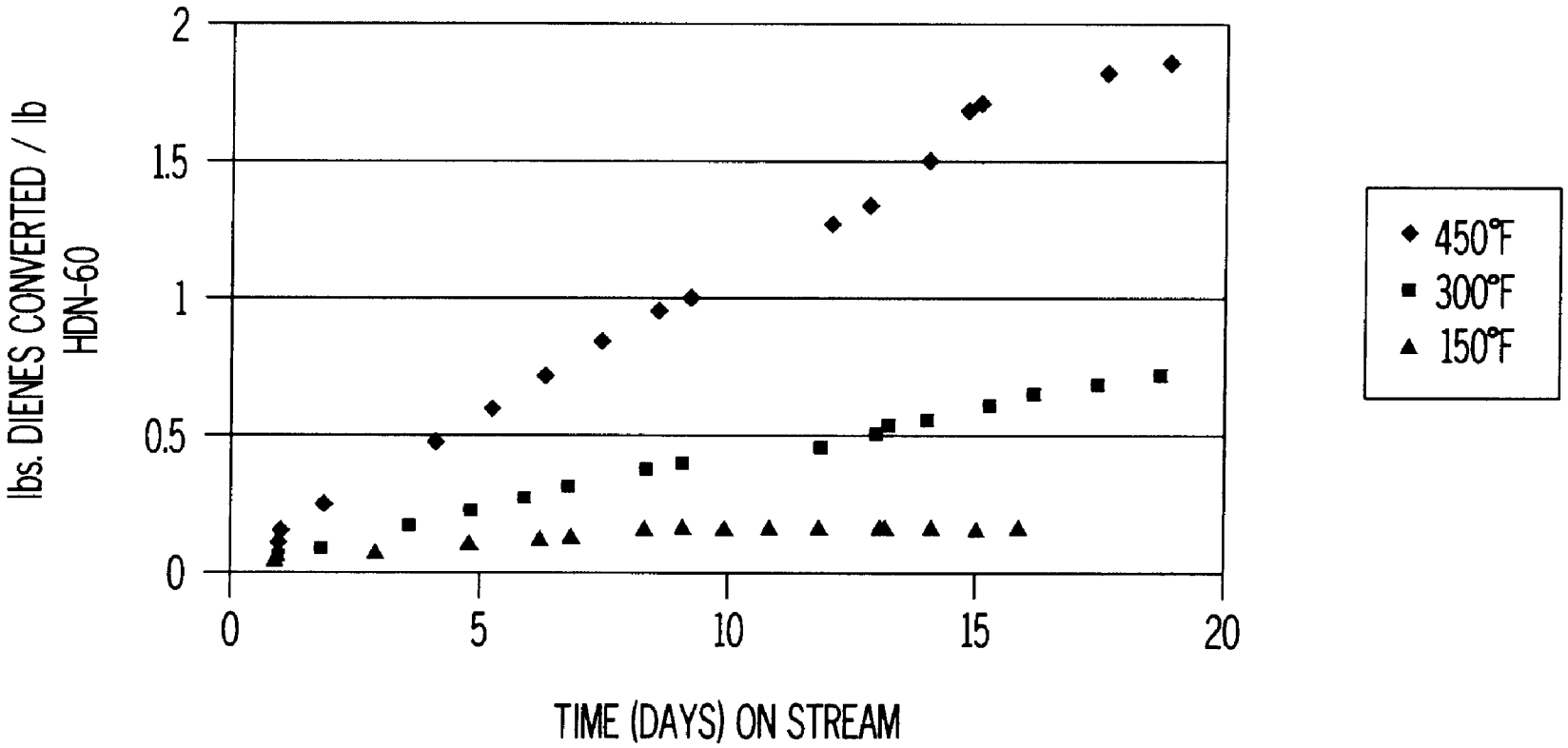
FIG. 3 is a graph showing the diene conversion per pound of catalyst at different temperatures over time.

At the beginning of the 300 and 450° F. runs, diene conversion was complete. FIG. 3 shows total pounds of dienes converted per pound of catalyst versus time (in days) on stream for each run. The curves for this type of plot are typically linear for a stable catalyst. As the catalyst begins to age, the curve begins to bend and becomes horizontal when the catalyst is completely deactivated. FIG. 3 shows that the catalyst aged steadily in each run. The total diene oligomerization capacity can be estimated by extrapolating the curve to horizontal. By extrapolating the curves in FIG. 3, total diene oligomerization capacities in pounds diene per pound catalyst per cycle were obtained for the three runs. These results showed total diene oligomerization of 0.25 at 150° F., 1.0 at 300° F. and 3.0 at 450° F. By operating at higher temperatures, the HDN-60 catalyst removed greater amounts of diene from the feed.

From a practical perspective, clay treaters can be operated at temperatures up to 470° F., without having to add additional heat. The test results in Example 3 show that diene removal capacity continues to rise as the reactor temperature is increased to 450° F. Therefore, these test results show that the performance of hydrotreating catalyst in diene removal service is optimized as the operating temperature approaches the maximum unit temperature.

EXAMPLE 4

The same light aromatics extract used in Example 3 was used in this example. The light aromatics extract was run through a bed of self-bound MCM-22 catalyst at 40 WHSV, 450° F. and 350 psig. Once each week the feedstock flow rate was increased to achieve 100 WHSV and partial olefin conversion. Olefin conversion versus days on stream is plotted in FIG. 4.

EXAMPLE 5

The same light aromatics extract used in Examples 3 and 4 was used in this example. The light aromatics extract was run through a bed of HDN-60 hydrotreating catalyst at 8.5 WHSV followed by self-bound MCM-22 catalyst at 40 WHSV, 450° F. and 350 psig. Once each week the feedstock flow rate was increased to achieve 8.5 WHSV on HDN-60 and 100 WHSV on MCM-22 and partial olefin conversion. Olefin conversion versus days on stream is plotted in FIG. 4.

Figure 4:
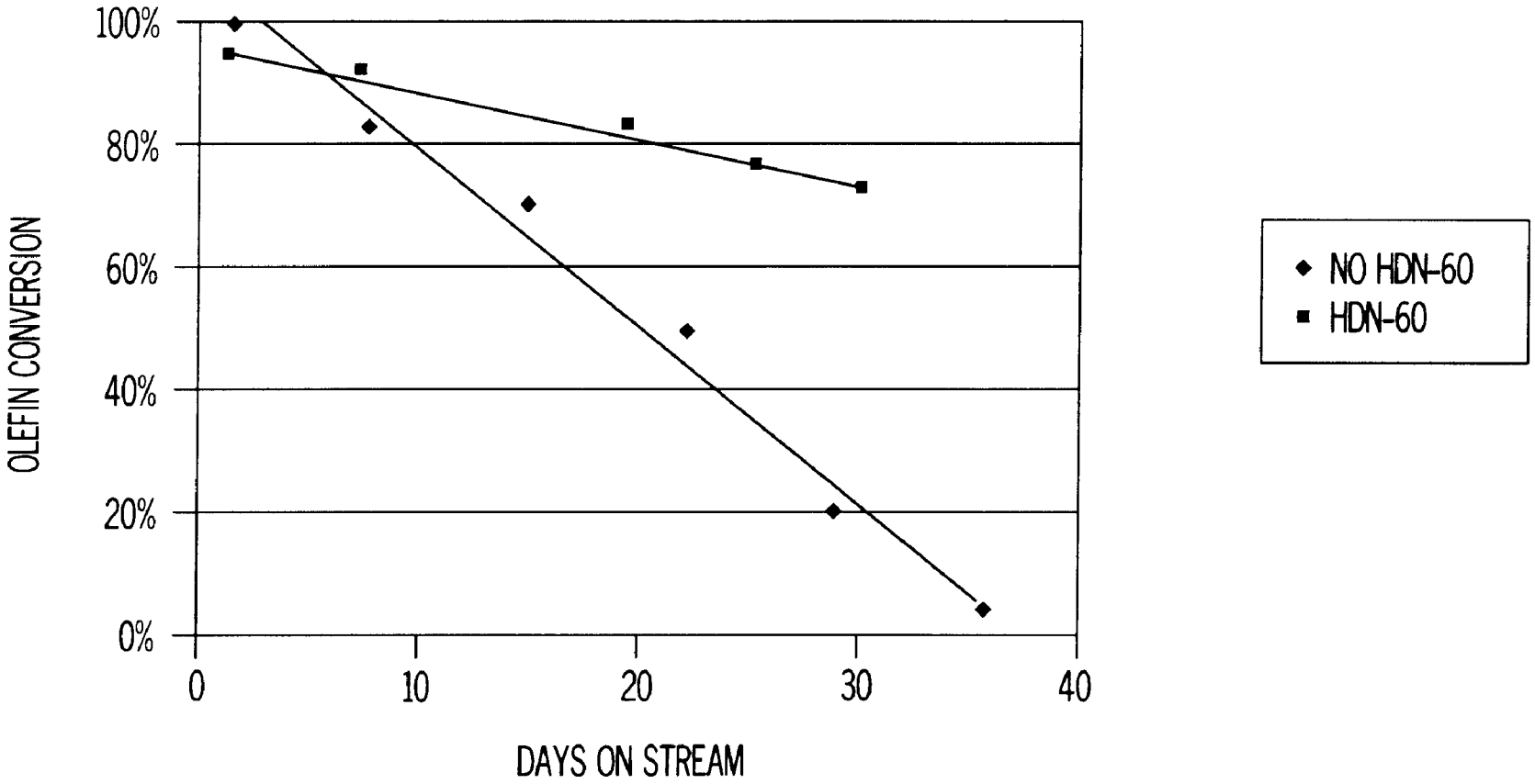
FIG. 4 is a graph showing the olefin conversion rate of a MCM-22 catalyst when used alone and when used in combination with HDN-60 catalyst.

The results in FIG. 4 show that the use of the HDN-60 upstream of the MCM-22 reduces the aging of the MCM-22.

EXAMPLES 6–12

For Examples 6 to 12, a heavy reformate with a BI of 550 was used as a feedstock. The heavy reformate was a $C_7^+$ cut of full-range CCR reformate containing 50 wt % toluene, 37 wt % $C_8$ aromatics, 12 wt % $C_9^+$ aromatics, and 0.27 wt % olefins. No dienes were detected in this feed using standard GC analysis.

EXAMPLE 6

The heavy reformate feedstock was processed at 52 WHSV over self-bound MCM-22 at 410° F. Total olefins converted versus days on stream is plotted in FIGS. 5 and 6.

EXAMPLE 7

The heavy reformate feedstock was processed at 52 WHSV over F-24 clay at 410° F. Total olefins converted versus days on stream is plotted in FIGS. 5 and 6.

EXAMPLE 8

The heavy reformate feedstock was processed at 52 WHSV over a 65 wt % mordenite/35 wt % alumina binder catalyst, sized to 14/40 mesh, at 410° F. Total olefins converted versus days on stream is plotted in FIGS. 5 and 6.

EXAMPLE 9

The heavy reformate feedstock was processed at 52 WHSV over a 75 wt % REY/25 wt % alumina binder catalyst, sized to 14/40 mesh, at 410° F. Total olefins converted versus days on stream is plotted in FIGS. 5 and 6.

EXAMPLE 10

The heavy reformate feedstock was processed at 52 WHSV over a 75 wt % USY/25 wt % alumina binder catalyst, sized to 14/40 mesh, at 410° F. Total olefins converted versus days on stream is plotted in FIGS. 5 and 6.

EXAMPLE 11

The heavy reformate feedstock was processed at 52 WHSV over MICT-6 catalyst, sized at 14/40 mesh, at 410° F. Total olefins converted versus days on stream is plotted in FIGS. 5 and 6.

EXAMPLE 12

The heavy reformate feedstock was processed at 52 WHSV over a self-bound zeolite beta catalyst, sized to 14/40 mesh, at 410° F. Total olefins converted versus days on stream is plotted in FIGS. 5 and 6.

Figure 5:
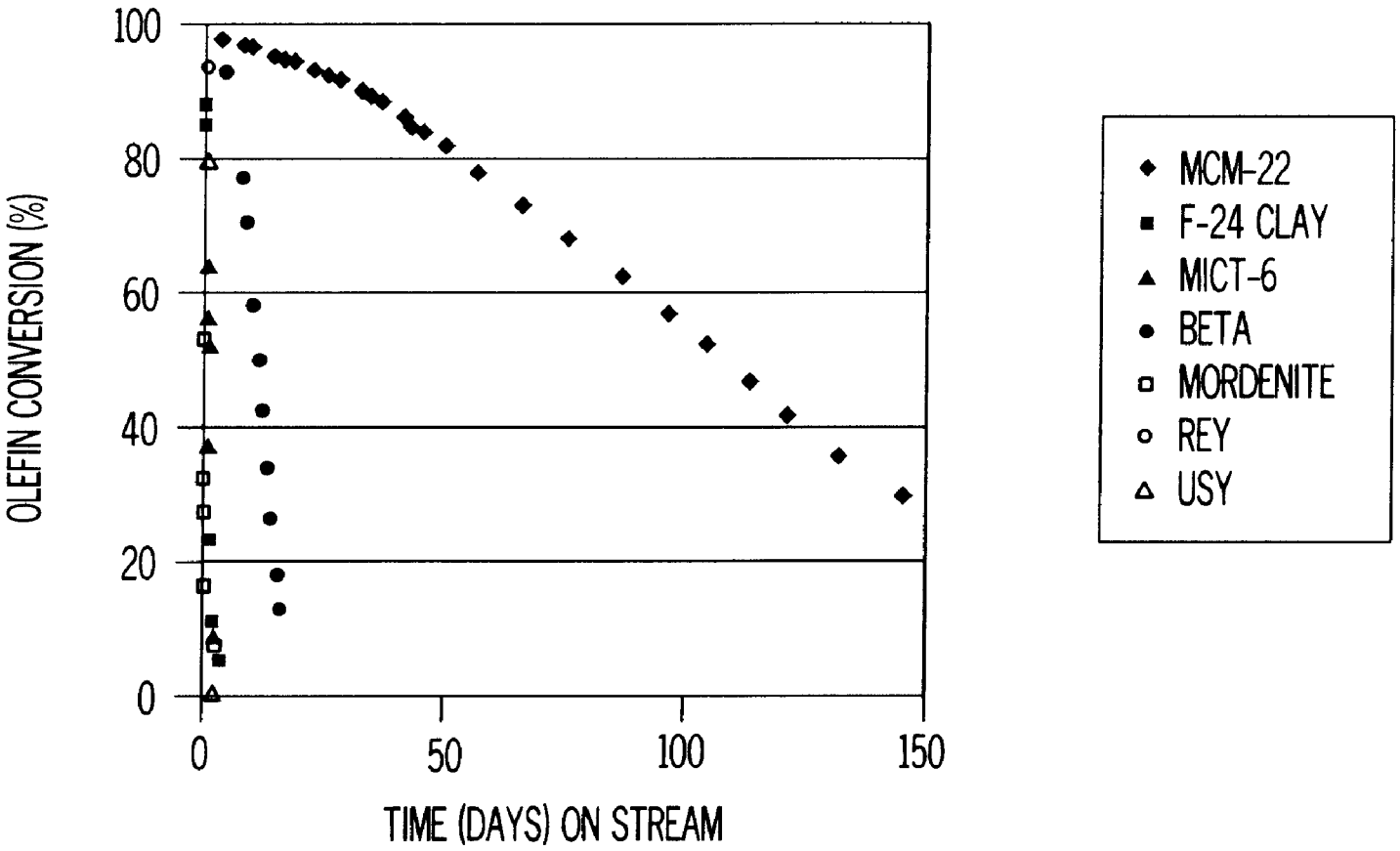
FIG. 5 is a graph showing the olefin conversion rate of different catalysts over time.
Figure 6:
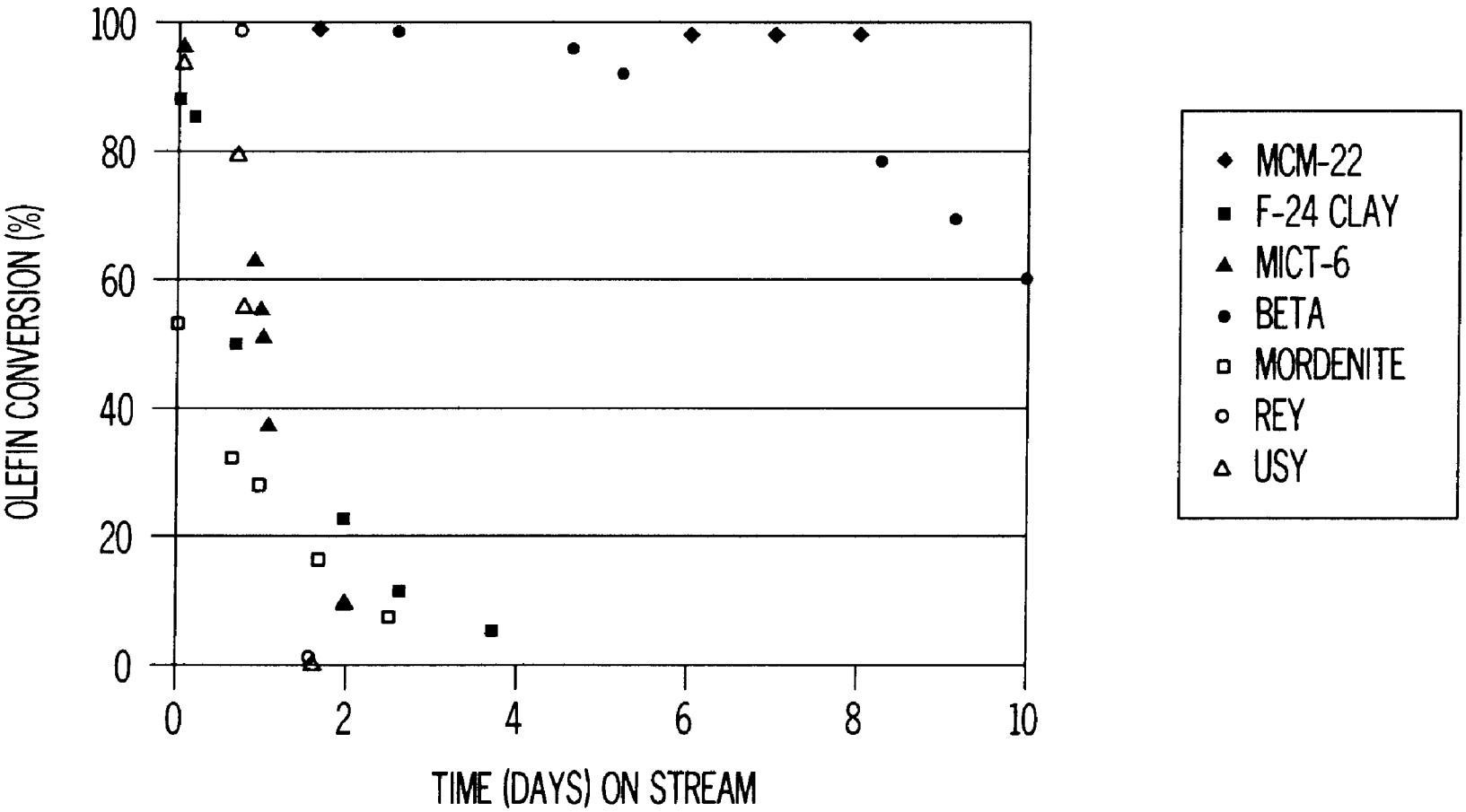
FIG. 6 is a graph showing the olefin conversion rate of different catalysts over time.

Examples 6 to 12 show that the catalyst materials tested have a wide range of stabilities at the constant conditions of the test. The most stable materials are MCM-22 and zeolite beta. FIG. 5 shows that MCM-22 and zeolite beta have approximately the same level of stability over the first five days on stream. However, over longer periods of time, FIG. 6 shows that MCM-22 is significantly more stable than zeolite beta and the other catalyst materials. For example, MCM-22 is over 100 times more stable than the current commercially used F-24 clay.

Figure 7:
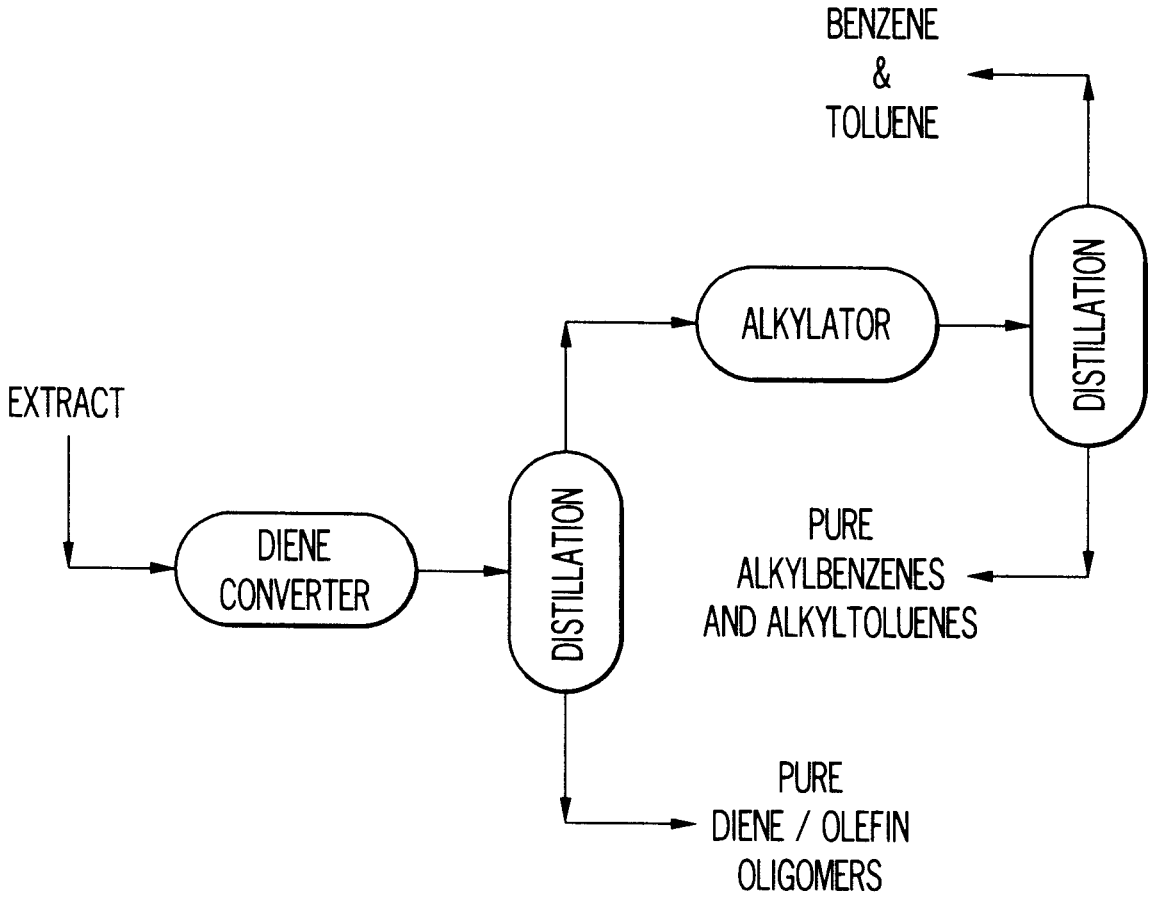
FIG. 7 is a flow schematic of a preferred embodiment of the present invention.

The present invention can be used to produce alkylaromatics and diene oligomers from extracted benzenes and toluenes. FIG. 7 shows a process flow scheme, wherein a light aromatics extract feed 10 containing primarily benzene and toluene with small amounts of diene and olefin contaminants is sent to a first reactor 12 for contacting with first catalyst, where the dienes in the feed 10 are substantially converted to oligomers and the olefins are partially converted to alkylaromatics. The reactor effluent 14 is then separated in a distillation tower 16 to remove the oligomers 18. The oligomer depleted stream 20 is sent to a second reactor 22 where a molecular sieve converts olefins to alkylaromatics. The effluent 24 from the second reactor 24 is sent to a distillation tower 26, where benzene and toluene 30 is separated from alkylbenzenes and alkyltoluenes 28. In some embodiments of the present invention, the effluent 24 is sent to a clay treater to further convert the olefins to alkylaromatics before being sent to the distillation tower 26.

Thus, while there have been described the preferred embodiments of the present invention, those skilled in the art will realize that other embodiments can be made without departing from the spirit of the invention, and it is intended to include all such further modifications and changes as come within the true scope of the claims set forth herein.

What we claim is:

1. A method for the treatment of an aromatics reformate to remove olefins therefrom, said method comprising contacting said reformate with a hydrotreating catalyst to substantially convert dienes contained therein to oligomers and to partially convert said olefins to alkylaromatics, separating at least some of said oligomers from said hydrotreated reformate, and then contacting the hydrotreated reformate with a molecular sieve to convert at least part of the remaining olefins to alkylaromatics.

2. The method according to claim 1, wherein said molecular sieve is selected from the group consisting of ZSM-4, ZSM-12, mordenite, ZSM-18, ZSM-20, zeolite beta, zeolite X, zeolite Y, USY, REY, MCM-22, MCM-36, MCM-49, MCM-56, M41S and MCM-41.

3. The method according to claim 2, wherein said molecular sieve is self-bound MCM-22.

4. The method according to claim 2, wherein said molecular sieve is MCM-22.

5. The method according to claim 2, wherein said molecular sieve is zeolite beta.

6. The method according to claim 1, further comprising clay treating said reformate after contacting with said molecular sieve to substantially convert any remaining olefins to alkylaromatics.

7. The method according to claim 6, wherein said hydrotreating catalyst is a nickel-molybdenum/alumina catalyst, said zeolite is MCM-22, and wherein more than 95 percent of said dienes and said olefins in said aromatics reformate are converted.

8. The method according to claim 1, wherein said hydrotreating catalyst has a metal component selected from the group consisting of: nickel, cobalt, chromium, vanadium, molybdenum, tungsten, nickel-molybdenum, cobalt-nickel-molybdenum, nickel-tungsten, cobalt-molybdenum, and nickel-tungsten-titanium.

9. The method according to claim 1, wherein said hydrotreating catalyst is a nickel-molybdenum/alumina catalyst.

* * * * *